US009388034B2

(12) United States Patent
Hearon

(10) Patent No.: US 9,388,034 B2
(45) Date of Patent: Jul. 12, 2016

(54) ADAPTER ASSEMBLY AND A PROCESS FOR SUPPLYING A STERILANT TO A PACKAGING SYSTEM FOR CLEANING AND FILLING OF PACKAGES

(75) Inventor: Matthew Hearon, Seabrook, TX (US)

(73) Assignee: SOLVAY SA, Brussels (BE)

( * ) Notice: Subject to any disclaimer, the term of this patent is extended or adjusted under 35 U.S.C. 154(b) by 54 days.

(21) Appl. No.: 14/343,865

(22) PCT Filed: Sep. 13, 2012

(86) PCT No.: PCT/EP2012/067907

§ 371 (c)(1),
(2), (4) Date: Mar. 10, 2014

(87) PCT Pub. No.: WO2013/037866

PCT Pub. Date: Mar. 21, 2013

(65) Prior Publication Data

US 2014/0230953 A1 Aug. 21, 2014

Related U.S. Application Data

(60) Provisional application No. 61/535,456, filed on Sep. 16, 2011, provisional application No. 61/553,715, filed on Oct. 31, 2011.

(51) Int. Cl.
*B67D 7/02* (2010.01)

(52) U.S. Cl.
CPC ..... *B67D 7/0288* (2013.01); *B67D 7/0283* (2013.01)

(58) Field of Classification Search
CPC ..... A61J 1/148; A61J 1/2072; A61J 1/2075; B67D 7/0288
USPC ..... 141/2, 18, 383–384, 374, 285; 215/307, 215/276; 220/203.11; 222/382
See application file for complete search history.

(56) References Cited

U.S. PATENT DOCUMENTS

| | | | | |
|---|---|---|---|---|
| 4,699,298 | A | 10/1987 | Grant et al. | |
| 4,941,519 | A | 7/1990 | Sestak et al. | |
| 4,993,573 | A | 2/1991 | Freidel et al. | |
| 5,533,651 | A | 7/1996 | Eddy et al. | |
| 5,598,939 | A * | 2/1997 | Watson | A61J 1/2096 215/277 |
| 6,371,443 | B1 | 4/2002 | Imai | |
| 6,536,188 | B1 | 3/2003 | Taggart | |
| 6,568,427 | B2 | 5/2003 | Imai | |
| 2005/0092392 | A1 | 5/2005 | Abe | |

(Continued)

FOREIGN PATENT DOCUMENTS

| | | | |
|---|---|---|---|
| EP | 1762252 | A1 | 3/2007 |
| ES | 1076702 | U | 4/2012 |
| GB | 2247451 | A | 3/1992 |

(Continued)

OTHER PUBLICATIONS

U.S. Appl. No. 14/356,796, Matthew Hearon.

*Primary Examiner* — Mark A Laurenzi
*Assistant Examiner* — Timothy P Kelly

(57) ABSTRACT

An adapter assembly (10) and a process for supplying a sterilant to a packaging system for cleaning and filling of packages. Specifically, an adapter assembly (10) for directly supplying from a packaging container, such as a blow-molded tight-head plastic packaging container, a sterilant, such as hydrogen peroxide, to the packaging system without using any intermediate carrier, such as a carboy.

19 Claims, 4 Drawing Sheets

(56) References Cited

U.S. PATENT DOCUMENTS

2006/0255075 A1* 11/2006 Foster ..... B05B 11/3011 222/383.1
2007/0277904 A1 12/2007 Martin

FOREIGN PATENT DOCUMENTS

JP 2002274519 A 9/2002
KR 20020022849 A 3/2002
TW 025233 B 5/1979
WO WO 94/011298 A1 5/1994
WO WO 2002/062666 8/2002
WO WO 2011/104711 A1 9/2011
WO WO 2013068511 A1 4/2013

* cited by examiner

ADAPTER ASSEMBLY AND A PROCESS FOR SUPPLYING A STERILANT TO A PACKAGING SYSTEM FOR CLEANING AND FILLING OF PACKAGES

CROSS-REFERENCE TO RELATED APPLICATIONS

This application is a U.S. national stage entry under 35 U.S.C. §371 of International Application No. PCT/EP2012/067907 filed Sep. 13, 2012, which claims priority to U.S. provisional application No. 61/535,456 filed on Sep. 16, 2011 and to U.S. provisional application No. U.S. 61/553,715 filed on Oct. 31, 2011, the whole content of each of these applications being incorporated herein by reference for all purposes.

Should the disclosure of any patents, patent applications, and publications which are incorporated herein by reference conflict with the description of the present application to the extent that it may render a term unclear, the present description shall take precedence.

TECHNICAL FIELD

This invention relates to an adapter assembly and a process for supplying a sterilant to a packaging system for cleaning and filling of packages. Specifically, the present invention is directed to an adapter assembly for directly supplying from a packaging container, such as a blow-molded tight-head plastic packaging container, a sterilant, such as hydrogen peroxide, to the packaging system without using any intermediate carrier, such as a carboy.

STATE OF THE ART

Aseptic packaging, which is a well known method of packaging various products such as food, beverages, etc., can be defined as the filling of a commercially sterile product into a sterile package under aseptic conditions and hermetically sealing the packages so that re-infection is prevented. This results in a product, which is shelf-stable at ambient conditions.

Aseptic packaging requires special treatment and handling of the product as well as all of the equipment that contacts the product until it is hermetically sealed inside the package. This process includes the destruction of all molds, yeasts and pathogens of concern for the specific product. Common sterilants employed in the process for attaining this commercial sterility include steam, heated air, and chemicals. Thus, it is known to produce sterilized packaging in which a sterile food product is placed in a sterilized package such as a pouch, a bottle, a laminated paper carton or another product package. The product is thus preserved for later storage or use. Various methods of sterilizing the product package or material used to make the product package, and filling the package with a sterilized product, are known.

These methods are usually conducted by the manufacturer and/or filler of the packages in a system or device for sterilizing and aseptic filling of packages which will be referred to in the following as aseptic packaging system.

Conventionally the sterilant, such as hydrogen peroxide, is supplied by the manufacturer of the sterilant to the manufacturer and/or filler of the aseptic packages in a standard package such as a drum, pail, intermediate bulk container (IBC), or in bulk. The sterilant is then pumped, manually poured, or otherwise transferred to a carboy. The carboy is generally made of stainless steel and has an interface, which is designed to mate with a corresponding interface of the aseptic packaging system. The carboy with the sterilant is then carried to the aseptic packaging system and placed inside a cabinet thereof where the interfaces are connected to each other. Depending on the model of the aseptic packaging system the sterilant is then either pumped out of the carboy into the packaging system, e.g., with a pumping means, or it is supplied into the packaging system by a slight overpressure which is applied to interior of the carboy.

However, such use of a carboy for intermediate transfer of the sterilant makes the entire process time-consuming and renders the automated control difficult. In addition, the sterilant is frequently contaminated during the transfer to the aseptic packaging system, which also affects the quality of the final product. Furthermore, during the transfer and especially when manually pouring or pumping the sterilant a participating personnel may be exposed to the sterilant. This may lead to safety incidents if the sterilant is harmful or if a contaminated sterilant will become unstable and thus result in injury or equipment damage due to decomposition. The same problems arise in extended shelf-life packaging systems.

U.S. Pat. No. 4,941,519 discloses in FIG. 10 an apparatus for dispensing a liquid, particularly hydrogen peroxide, from a non-reusable container into equipment, the container having an externally threaded neck surrounding a container opening. The apparatus comprises an insert for insertion into the container neck having a dispensing passage and at least one venting or pressurizing passage. In addition the apparatus comprises a dip tube communicating with the dispensing passage the dip tube being fitted to the insert. A gasket is disposed between the insert and the rim of the container neck. The insert is provided with a unitary screw thread for engagement with the externally threaded neck of the packaging container, US 2005/0092392 A1 discloses in FIG. 10 a connector for dispensing liquid from a tank comprising a connector body having a dispensing passage and at least one venting or pressurizing passage. The connector comprises a screw cap for engagement with an externally threaded neck of the tank the screw cap being rotatable with respect to the connector body.

SUMMARY OF THE INVENTION

One object of the invention is to dispense with the above mentioned disadvantages and to supply the sterilant to the packaging system without intermediate transfer into a carboy. Another object of the invention is to provide means for supplying the sterilant directly from the packaging container filled by the manufacturer of the sterilant into the packaging system in order to more effectively establish clean, in particular aseptic environment in the packaging system without any safety or contamination issue.

In order to achieve these objects the present invention provides an adapter assembly according to claim 1 and a process according to claim 14.

With the adapter assembly and process according to the invention it is possible to supply the sterilant directly from a standard and readily available packaging container with an externally threaded neck surrounding a container opening and with an internally threaded screw cap for sealing the container opening, in particular from a blow-molded tight-head plastic packaging container, into the packaging system without any intermediate transfer.

To this end the screw cap of the packaging container is removed and is replaced by the adapter assembly according to the invention which comprises: an adapter body having a tubular body portion and a discoidal body portion at a first end of the tubular body portion, a dispensing passage and at least one venting or pressurizing passage extending through the adapter body from the first end to the second end of the tubular body portion, and a dip tube fitted to the first end of the tubular body portion and communicating with the dispensing passage; a gasket surrounding the dip-tube and having at least one venting or pressurizing hole communicating with the venting or pressurizing passage of the adapter body; and a screw cap having an annular cap portion with a through-hole for the tubular body portion of the adapter body and a skirt portion with an internal thread for engagement with the externally threaded neck of the packaging container, the screw cap being rotatable with respect to the adapter body.

The dispensing passage extending through the adapter body is for dispensing the sterilant from the packaging container to the packaging system whereas the at least one venting or pressurizing passage extending through the adapter body is for venting the packaging container during the supply of the sterilant from the packaging container to the packaging system or for applying an overpressure to the interior of the packaging container for displacing the sterilant from the packaging container to the packaging system by means of the overpressure in the packaging container.

The dip tube extends trough the container opening into the container where its lower end is located close to the container bottom in order to be able to almost completely empty the packaging container in an upright position of the packaging container.

The discoidal body portion of the adapter body is for pressing the gasket against the rim of the opening of the packaging container when the screw cap of the adapter assembly is screwed onto the neck of the packaging container in order to sealingly close the packaging container except for the dispensing passage and the least one venting or pressurizing passage.

In order to replace the screw cap of the packaging container with the adapter assembly and to supply sterilant directly from the packaging container into the packaging system the process according to the invention comprises the steps of: removing the internally threaded screw cap from the externally threaded neck of the packaging container, sealingly attaching the adapter assembly to the packaging container by engagement of the internal thread of the skirt portion of the screw cap with the externally threaded neck of the packaging container after introducing the dip tube into the container opening, connecting an interface of the packaging system to the tubular body portion of the adapter body, and then supplying the sterilant directly from the packaging container through the adapter body into the packaging system.

With the adapter assembly and the process according to the invention it is thus possible to significantly reduce the necessary manual labor and risks as well as a contamination of the sterilant from the environment and to simplify the supply of the sterilant to the packaging system. It has been found that the use of the adapter assembly and the process according to the invention allow the user to supply the sterilant provided by the manufacturer directly into a packaging system, and the process of transferring the sterilant using an intermediate container such as a carboy is eliminated. Thus, the adapter assembly and the process of the present invention provide an improvement where the manual labor is reduced and where the quality of the sterilant is improved since contact with the environment is avoided or minimized. In addition to that there are no risk and safety issues compared with a manual transfer to a carboy.

BRIEF DESCRIPTION OF THE DRAWINGS

The present invention is illustrated by reference to the drawing figures, encompassing different views of a preferred embodiment of the invention, wherein.

DETAILED DESCRIPTION

Figure 1:
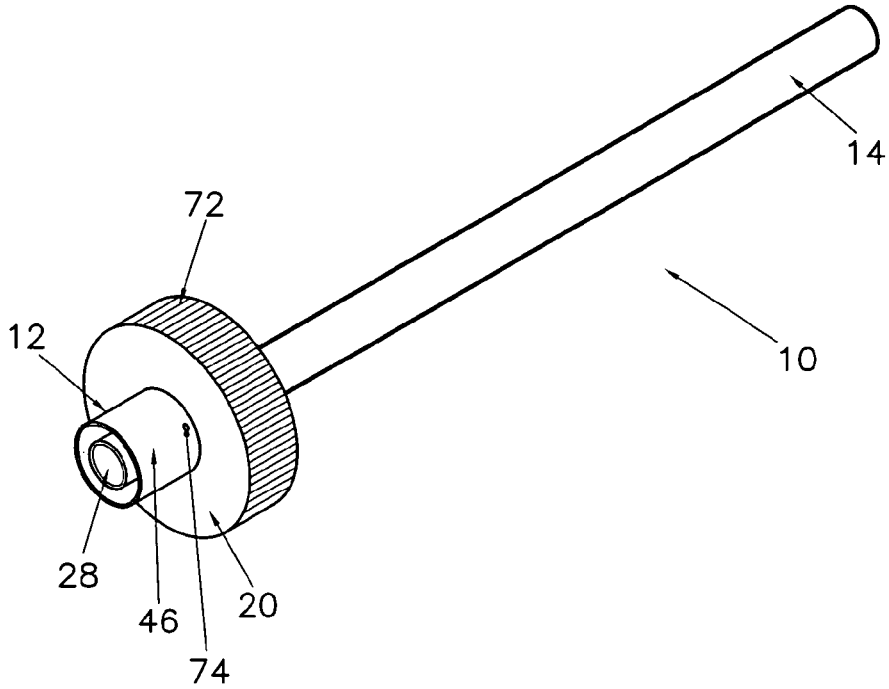
FIG. 1 is a perspective view of an exemplary adapter assembly according to the present invention for directly dispensing a sterilant from a packaging container.

The "packaging system" can be an aseptic packaging system for sterilizing and aseptic filling of packages. Alternatively the packaging system can be an extended shelf-life packaging system.

The term "aseptic" herein refers to a system and/or a process wherein a commercially sterilized package or packaging material, e.g., a bottle or a pouch or a laminated paper carton constructed in a vertical form/fill/seal process, is filled with a commercially sterilized product, e.g., a food product, in a hygienic environment. The product is thus rendered shelf stable in normal nonrefrigerated conditions. The package or packaging material, and the product, are typically separately sterilized before filling.

The expression "commercially sterile" herein refers to a level of sterility in packaged foods where they are not completely sterile but where they do not contain microorganisms that could cause health problems.

As already mentioned the term "aseptic packaging system" refers to a system or device for sterilizing and aseptic filling of packages, such as pouches, bottle, laminated paper cartons or other product packages.

The sterilization and aseptic filling of the product packages, which is also referred to as "aseptic packaging" comprises (i) sterilization of the products before filling, (ii) sterilization of packaging materials and closures before filling, (iii) sterilization of aseptic installations before operation, (iv) maintaining sterility in this total system during operation and sterilization of all media entering the system, like air, gases, sterile water, and (v) production of hermetic packages. Such aseptic packaging is described in detail in U.S. Pat. No. 6,536,188 which is incorporated herein by its entirety by reference.

Extended shelf-life (ESL) processing is normally processed using sterilization times and temperatures to effect sterilization. However, this product is most likely filled and sealed using a filler that has not received FDA validation. Therefore the final product cannot be stored and distributed at room temperature. ESL products are normally filled at or near a refrigerated temperature for storage and distribution. How much shelf-life extension is gained by these ultra-clean techniques varies with the nature of the product being filled, but it is common to see a shelf-life extension from 25 to 100 days for dairy-based products.

For sterilization and shelf-life extension, a number of sterilants in a liquid, powder or gaseous form, preferably in a liquid form, are used in packaging systems, such as various acids, ethanol, oxides such as ethylene oxide and hydrogen peroxide and peracetic acid, preferably peroxides, and more preferably hydrogen peroxide or its solutions, most preferably an aqueous solution of hydrogen peroxide with a concentration of from 30 to 35%. Such aqueous solution of hydrogen peroxide is described in detail in European Patent Publication No. EP 1 762 252, which is incorporated herein in its entirety by reference. Hot air of a temperature of for example from 60° C. to 125° C. can later be used to dissipate residual hydrogen peroxide, and to increase the sporicidal activity of hydrogen peroxide since its activity increases substantially with increasing temperatures.

The package materials used in the packaging system may be any materials which meet the following requirements regarding compatibility with aseptic or extended shelf-life packaging: the material must be compatible with the product intended to be packed and comply with applicable material migration requirements and has physical integrity of the package which is necessary to assume containment of the product and maintenance of sterility. The package material must also be able to withstand sterilization and be compatible with the methods of sterilization, and the package must protect the product from oxygen, also the package must retain the aroma of the product. Such materials include, but are not limited to, paper, metallic film such as aluminum foil or metalized films, polyolefins such as polyethylene, polypropylene, polyvinylidene chloride, polystyrene, polyvinyl alcohol, acrylic polymers, condensation polymers such as Nylon and other polyamides, their copolymers, and combinations thereof. In a specific embodiment, a plurality of layers having different materials may be used where each layer provides each specific function. One example of such multilayered package is a laminated paper-aluminum-foil-plastic container developed by Tetra Pak®.

According to a preferred embodiment of the invention the sterilant is supplied by the manufacturer of the sterilant in a commercial packaging container the dimensions of which are such that it can be placed in the cabinet of the packaging system instead of a carboy.

Preferably the commercial packaging container is a blow-molded tight-head plastic packaging container, most preferably a tight-head packaging container, which meets UN packaging type 1H1 requirements and is commonly used for transporting hydrogen peroxide in aqueous solution. The external thread on the container neck is a preferably 70 mm 6 thread-per-inch buttress thread and accordingly the screw cap of the adapter assembly preferably will have a 70 mm 6 thread-per-inch internal buttress thread, in order to provide for a tight engagement of the external and internal threads.

In order to match the adapter assembly with existing interfaces of packaging systems the tubular body portion of the adapter body preferably has four venting or pressurizing passages spaced in 90°-intervals and arranged radially outwardly from the central dispensing passage. Furthermore the second end of the tubular body portion opposite from the first end is provided with an external thread for connection to the interface of a packaging system.

According to a further preferred embodiment of the invention the annular gasket is a flat gasket with a planar upper surface and a planar lower surface the former facing a planar lower surface of the discoidal body portion and the latter for abutment with a planar rim surrounding the container opening of the packaging container. In addition the annular cap portion of the screw cap preferably has a planar lower surface and the discoidal body portion of the adapter body preferably has an opposing planar upper surface. In this way a very tight seal between the adapter body and the packaging container can be achieved when the screw cap of the adapter assembly is screwed onto the neck of the packaging container and is tightened.

In order to prevent a blocking of the venting or pressurizing passages by the gasket when the screw cap of the adapter assembly is screwed onto the neck of the packaging container preferably the discoidal body portion has a recess surrounding the dip tube, the at least one venting or pressurizing passage of the tubular body portion opens into the recess and the at least one venting or pressurizing hole of the annular gasket faces the recess, so that the interior of the packaging container communicates through the at least one venting or pressurizing hole of the gasket and through the recess with the at least one venting or pressurizing passage. Preferably the annular gasket has a plurality of venting or pressurizing holes facing the recess.

In order to retain the gasket in its position around the dip tube and in close proximity of the discoidal body portion of the adapter body preferably the adapter assembly comprises a ferrule which is disposed on the dip tube beyond the gasket. Preferably the ferrule is fixedly attached to the dip tube.

For the assembly of the dip tube to the adapter body preferably an upper end of the dip tube is welded into a socket of the first end of the tubular body portion.

In order to retain the screw cap of the adapter assembly on the tubular body portion the latter is preferably provided with at least one projecting lug above the screw cap.

The adapter body, the dip tube, the gasket, the ferrule and the screw cap can be independently made from any appropriate material which is capable of withstanding a sterilant at the aseptic conditions under which the adapter assembly is used. Non-limiting examples of such materials for the adapter body, the dip tube, the ferrule and the screw cap, i.e., the entire adapter assembly with the exception of the gasket, include polymeric and metallic materials, preferably polyethylene or polypropylene and most preferably stainless steel such as 316 stainless steel in view of its commercial availability as well as durability against a number of chemicals. Although any suitable material may be used for the gasket, non-limiting examples include elastomers, preferably elastomeric polymers which are resistant to sterilants.

If the dip tube, the ferrule and the screw cap are made from stainless steel the ferrule is preferably tack-welded to the dip tube and the projecting lug of the tubular body portion of the adapter body is preferably a tack-weld bead.

The present invention is illustrated by reference to the drawing figures, encompassing different views of a preferred embodiment of the invention.

Figure 2:
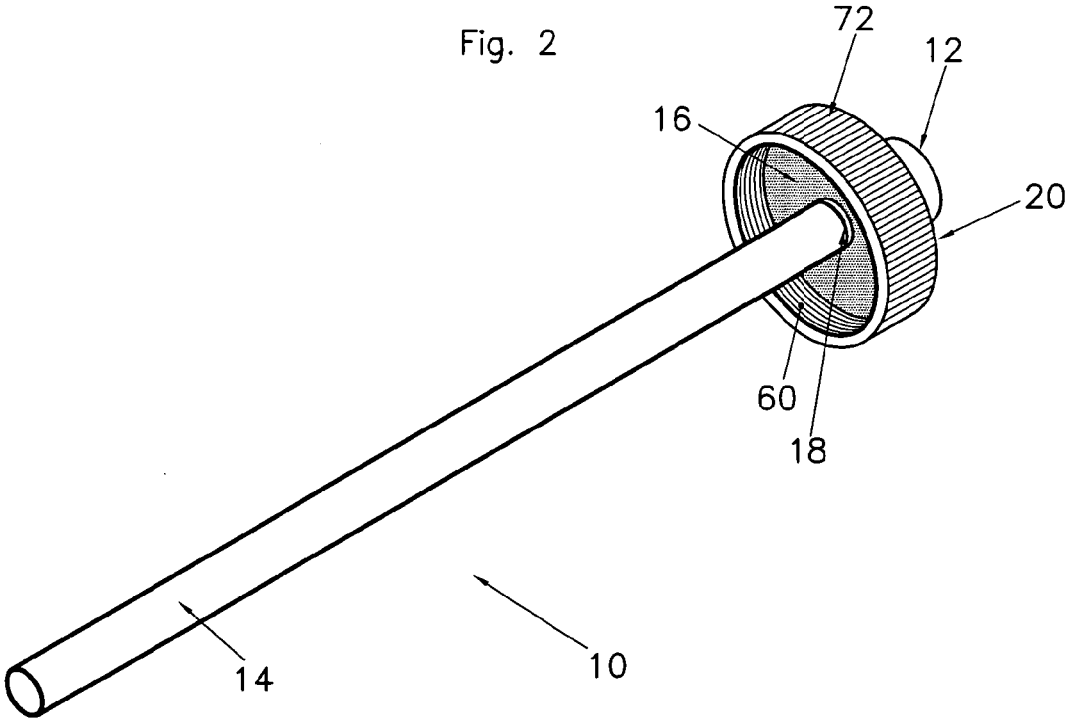
FIG. 2 is another perspective view of the adapter assembly.
Figure 3:
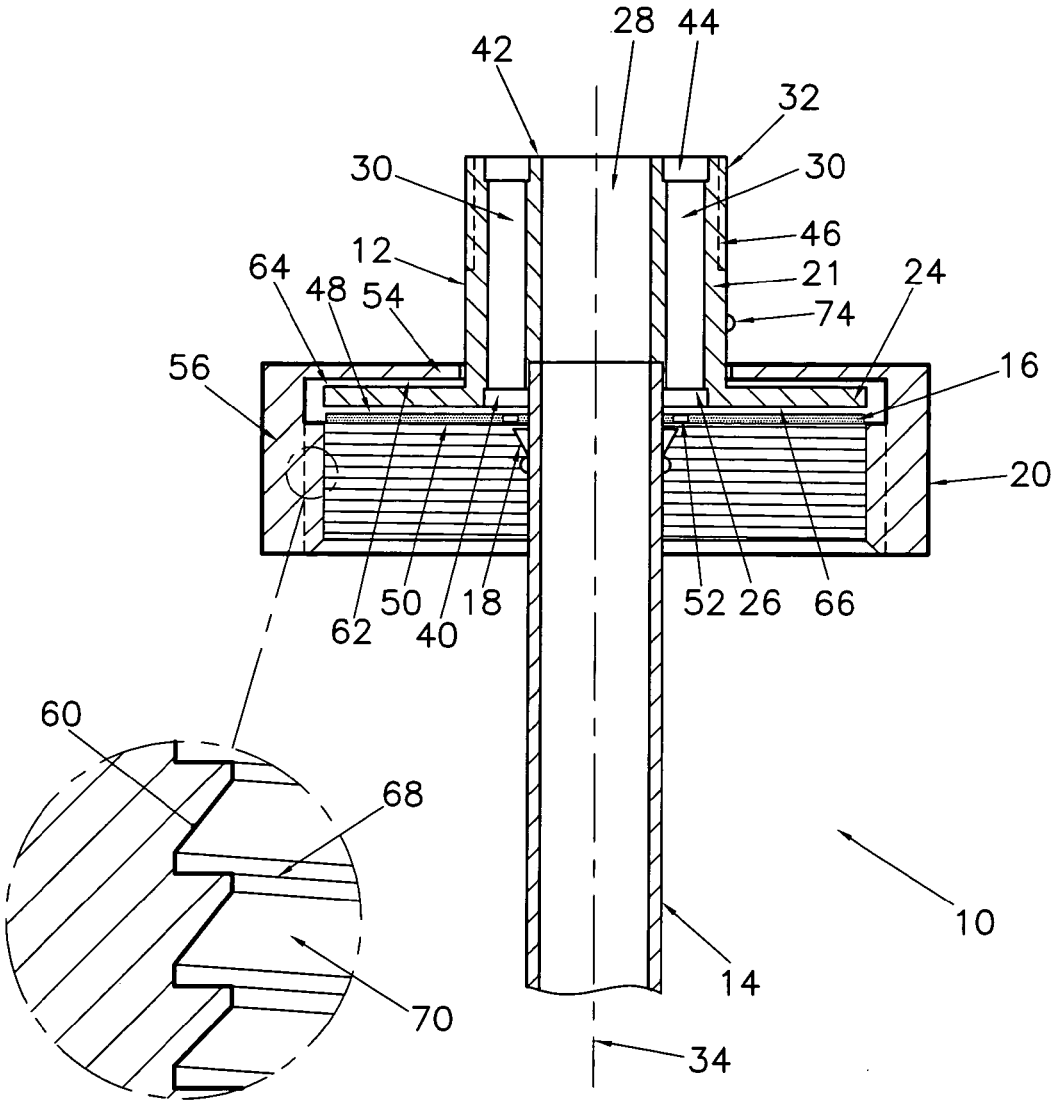
FIG. 3 is a partly cut-off cross-sectional view of the adapter assembly.
Figure 4:
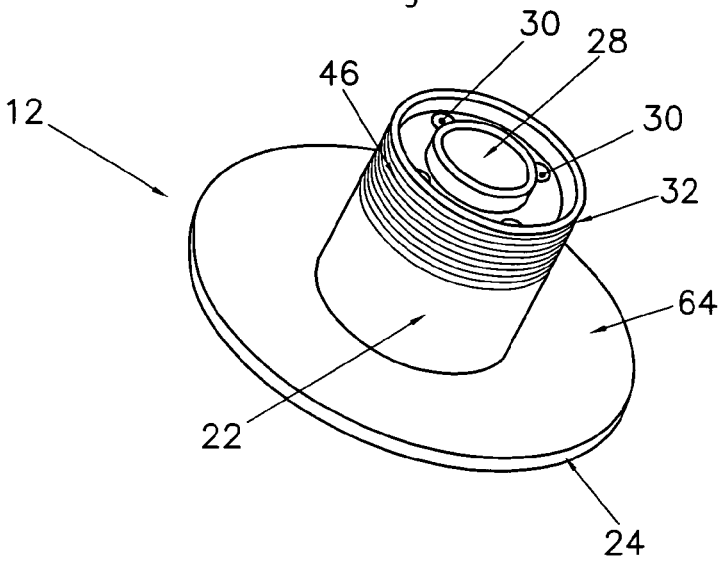
FIG. 4 is a perspective view of an adapter body of the adapter assembly.

The adapter assembly 10 as best depicted in FIGS. 1 to 3 is used for dispensing a sterilant, particularly hydrogen peroxide, directly from a blow-molded tight-head plastic packaging container (not shown), which meets UN packaging type 1H1 requirements and has an externally threaded neck with a container opening, into a packaging system (not shown) for cleaning, in particular sterilizing and filling, in particular aseptic filling of packages, in particular food or beverage packages, such as bottles or laminated carton packages with a food product.

The adapter assembly 10 comprises an adapter body 12, a dip tube 14 attached to the adapter body 12, a gasket 16 surrounding the dip-tube 14, a ferrule 18 for retaining the gasket 16 on the dip tube 14 and a screw cap 20 for mounting the adapter assembly 10 on the neck of the packaging container.

Figure 7:
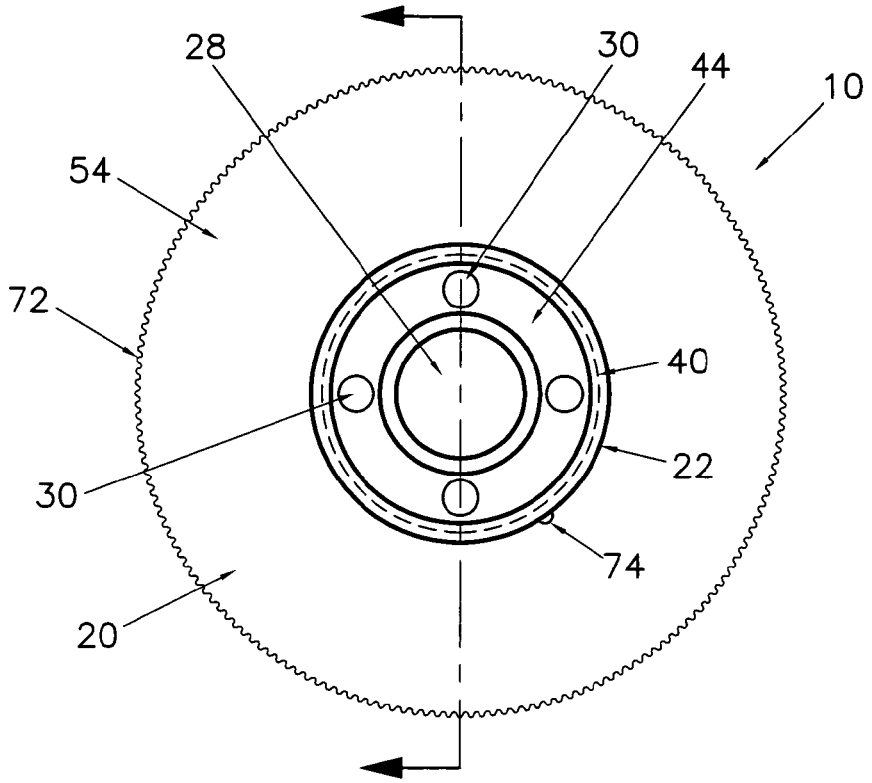
FIG. 7 is a top view of the adapter assembly.
Figure 8:
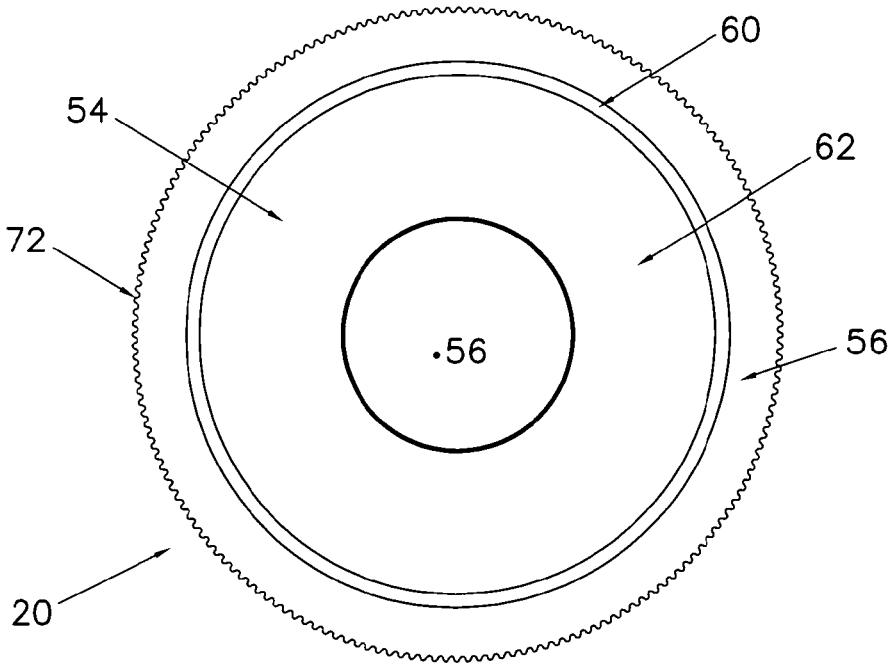
FIG. 8 is a bottom view of a screw cap of the adapter assembly.

The unitary adapter body 12 is made of 316 stainless steel and comprises a tubular body portion 22 and a discoidal body portion 24 at a first end 26 of the tubular body portion 22. The tubular body portion 22 and the discoidal body portion 24 each have a cylindrical outer surface. The tubular body portion 22 is provided with a central dispensing passage 28 having a larger inner diameter and four venting or pressurizing passages 30 having a smaller inner diameter. The central dispensing passage 28 and the four venting or pressurizing passages 30 extend axially through the adapter body 12 from the first end 26 to a second end 32 of the tubular body portion 22. The central dispensing passage 28 is coaxial with a longitudinal axis 34 of the adapter assembly 10. The four venting or pressurizing passages 30 are spaced in 90°-intervals around the dispensing passage 28, as can be best seen in FIG. 7.

Figure 5:
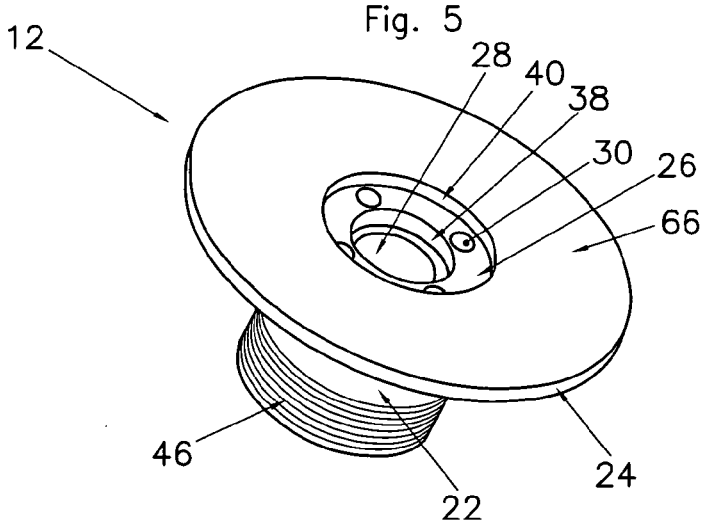
FIG. 5 is another perspective view of the adapter body.
Figure 6:
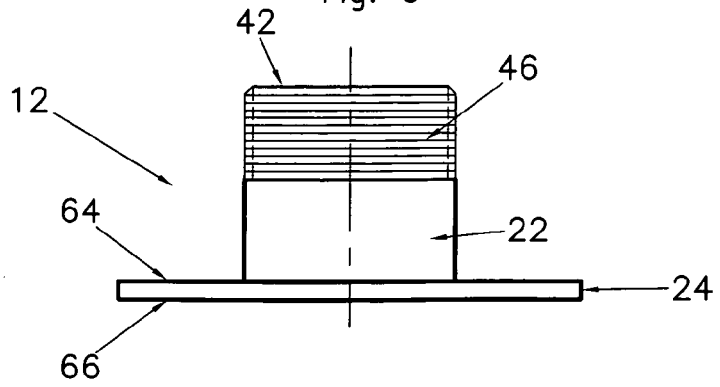
FIG. 6 is a side view of the adapter body.

At the first end 26 of the body portion 22 the central dispensing passage 28 communicates with the interior of the dip tube 14, whereas the four venting or pressurizing passages 30 open into a flat cylindrical recess 40 which is provided in the discoidal body portion 24, surrounds an upper end of the dip tube 14 and has an inner diameter slightly smaller than the outer diameter of the tubular body portion 22. In addition the first end 26 of the body portion 22 is provided with a shallow cylindrical socket 38 (FIG. 5) for attachment of the upper end of the dip tube 14. The socket 38 extends beyond the recess 40, is separated from the four venting or pressurizing passages 30 and has an inner diameter which is smaller than the inner diameter of the recess 40.

At the second end 32 of the body portion 22 the central dispensing passage 28 extends to a planar end face 42 of the body portion 22 whereas the four venting or pressurizing passages 30 open into a circular groove 44 which is recessed from the end face 42. Adjacent the second end 32 the body portion 22 is provided with an external thread 46 for connecting the adapter body 12 with an interface (not shown) of the packaging system.

The dip tube 14 is made of 316 stainless steel and is welded to the adapter body 12. Before attaching the dip tube 14 to the adapter body 12 the length of the dip tube 14 can be customized to fit the height of the tight-head packaging container so that the lower end of the dip tube 14 is close to the bottom of the packaging container. The outer diameter of the dip tube 14 corresponds to the inner diameter of the socket 38 so that the upper end of the dip tube 14 can be inserted into the socket 38 before it is welded to the first end 26 of the body portion 22 in order to provide for alignment of the longitudinal axis 34 of the adapter assembly 10 and the dip tube 14, as best shown in FIG. 3. The inner diameter of the dip tube 14 corresponds to the inner diameter of the dispensing passage 28.

The gasket 16 is a flat annular elastomer gasket with a planar upper surface 48 and a coplanar lower surface 50. The gasket 16 has a central hole for passing the dip tube 14 and four venting or pressurizing holes 52 radially spaced from the central hole. After the assembly on the upper end of the dip tube 14 the venting or pressurizing holes 52 are disposed below the recess 40 so that the interior of the packaging container communicates through the venting or pressurizing holes 52 and the recess 40 with the venting or pressurizing passages 30.

The ferrule 18 is made of 316 stainless steel and is tack welded to the outer surface of the dip tube 14 in order to retain the gasket 16 in position around the upper end of the dip tube 14.

The screw cap 20 has an annular cap portion 54 with a through-hole 56 for inserting the tubular body portion 22 of the adapter body 12 and a depending skirt portion 56 with an internal thread 60 for engagement with the externally threaded neck of the packaging container. The inner diameter of the through-hole 56 is larger than the ourter diameter of the body portion 22 so that the screw cap 20 is loosely fitted to the adapter body 12 and is rotatable with respect to the latter. The annular cap portion 54 has a planar lower surface 62 which faces a coplanar upper surface 64 of the discoidal body portion 24. The planar lower surface 66 of the discoidal body portion 24 faces the upper surface 48 of the gasket 16 so that the opposing surfaces 62, 64 and 66, 48 respectively are pressed against each other and the lower surface 50 of the gasket 18 is pressed against the opposing planar rim of the opening of the packaging container when the screw cap 20 is screwed onto the externally threaded neck of the packaging container and is tightened. The outer surface of the skirt portion 58 of the screw cap 20 is provided with a knurling 72 which allows hands or fingers to better grip the screw cap 20 for tightening.

In order to firmly press the discoidal body portion 24 of the adapter body 12 against the gasket 16 and to prevent any slack in the engagement of the screw threads of the screw cap 20 and the container neck the internal thread 60 of the screw cap 20 is in the form of an internal buttress thread which mates with a complementary external buttress thread on the container neck. As can be seen from the enlarged section of FIG. 3 the internal buttress thread 60 has two faces 68, 70 where the load bearing face 68 is perpendicular to the screw axis whereas the other face 70 is slanted at 45 degrees to the screw axis.

In order to retain the screw cap 20 on the adapter body 12 after the tubular body portion 22 has been introduced into the through-hole 56 of the screw cap 20 a radially projecting bead 74 is tack-welded to the outer surface of the body portion 22 as can be best seen in FIGS. 1 and 3.

The use of the adapter assembly 10 is as follows. After the sterilant, e.g., an aqueous solution of hydrogen peroxide, has been delivered from the manufacturer of the sterilant in the above mentioned tight-head plastic packaging container the screw cap of the packaging container is screwed off. Then the dip tube 14 of the adapter assembly 10 is introduced through the container opening into the interior of the container until the gasket 16 abuts to the planar rim of the packaging container. Next the screw cap 20 is screwed onto the externally threaded neck of the packaging container until a tight seal has been achieved. Then an interface of the aseptic packaging system is connected with the body portion 22 by means of the external thread 46. Finally the sterilant is dispensed from the packaging container through the adapter body 12 directly into the packaging system. This can be done either by pumping the sterilant from the packaging container with the aid of a pump installed in the packaging system and connected with the dispensing passage 28 or by applying an overpressure through the interface to the venting or pressurizing passages 30 for displacement of the sterilant.

Although this invention has been described broadly and also identifies specific preferred embodiments, it will be understood that modifications and variations may be made within the scope of the invention as defined by the following claims.

The invention claimed is:

1. An adapter assembly for supplying a sterilant from a packaging container with an externally threaded neck surrounding a container opening and with an internally threaded screw cap for sealing the container opening, into a packaging system for cleaning and filling of packages, the adapter assembly comprising:

an adapter body having a tubular body portion, a discoidal body portion at a first end of the tubular body portion, a dispensing passage and at least one venting or pressurizing passage extending through the adapter body from the first end to a second end of the tubular body portion, and a dip tube fitted to the first end of the tubular body portion and communicating with the dispensing passage;

a gasket surrounding the dip-tube and having at least one venting or pressurizing hole communicating with the venting or pressurizing passage of the adapter body; and a screw cap having an annular cap portion with a through-hole for the tubular body portion of the adapter body and having a skirt portion with an internal thread for engagement with the externally threaded neck of the packaging container, the screw cap being rotatable with respect to the adapter body;

wherein the discoidal body portion has a surface surrounding the dip tube, the at least one venting or pressurizing passage of the tubular body portion opens into the surface surrounding the dip tube, and the at least one venting or pressurizing hole of the gasket faces the surface surrounding the dip tube.

2. The adapter assembly according to claim 1, wherein the internal thread of the screw cap is a buttress thread.

3. The adapter assembly according to claim 1, wherein the tubular body portion has four venting or pressurizing passages spaced in 90°-intervals.

4. The adapter assembly according to claim 1, wherein the surface surrounding the dip tube defines a recess, the at least one venting or pressurizing passage of the tubular body portion opens into the recess, and the at least one venting or pressurizing hole of the gasket faces the recess.

5. The adapter assembly according to claim 1, wherein an upper end of the dip tube is welded into a socket of the first end of the tubular body portion.

6. The adapter assembly according to claim 1, wherein the gasket has a planar upper surface facing a planar lower surface of the discoidal body portion, and wherein the gasket has a planar lower surface for abutment with a planar rim surrounding the container opening of the packaging container.

7. The adapter assembly according to claim 1, wherein the gasket has a plurality of venting or pressurizing holes.

8. The adapter assembly according to claim 1, further comprising a ferrule on the dip tube for retaining the gasket in close proximity to the discoidal body portion of the adapter body.

9. The adapter assembly according to claim 8, wherein the ferrule and the dip tube are made from stainless steel, and wherein the ferule is tack-welded to the dip tube.

10. The adapter assembly according to claim 1, wherein the tubular body portion of the adapter body is provided with at least one projecting lug for retaining the screw cap.

11. The adapter assembly according to claim 10, wherein the adapter body is made from stainless steel, and wherein the at least one projecting lug is a tack-weld bead.

12. The adapter assembly according to claim 1, wherein the annular cap portion of the screw cap has a planar lower surface, and wherein the discoidal body portion of the adapter body has a planar upper surface facing the planar lower surface of the annular cap portion.

13. The adapter assembly according to claim 1, wherein the second end of the tubular body portion opposite from the first end is provided with an external thread.

14. A process for supplying a sterilant directly from a packaging container into a packaging system for cleaning and filling of packages, comprising the following steps:

providing the sterilant in the packaging container with an externally threaded neck surrounding a container opening and with an internally threaded screw cap for sealing the container opening, removing the internally threaded screw cap from the externally threaded neck of the packaging container, sealingly attaching the adapter assembly according to claim 1 to the packaging container by engagement of the internal thread of the skirt portion of the screw cap with the externally threaded neck of the packaging container after introducing the dip tube into the container opening, connecting an interface of the packaging system to the tubular body portion of the adapter body, and supplying the sterilant directly from the packaging container through the adapter body of the adapter assembly into the packaging system.

15. The process according to claim 14, wherein the step of supplying the sterilant directly from the packaging container through the adapter body into the packaging system comprises: a step of pumping the sterilant from the packaging container with a pump of the packaging system, or a step of applying an overpressure through the interface to the at least one venting or pressurizing passage at the second end of the tubular body portion of the adapter body for displacing the sterilant from the packaging container.

16. The process according to claim 14, wherein the packaging system is an aseptic packaging system for sterilizing and aseptic filling of packages or an extended shelf-life packaging system.

17. The process according to claim 14, wherein the packaging container is a blow-molded tight-head plastic container, and wherein the packages are food or beverage packages selected from the group consisting of pouches, bottles, and laminated carton packages.

18. An adapter assembly for supplying a sterilant from a packaging container with an externally threaded neck surrounding a container opening and with an internally threaded screw cap for sealing the container opening, into a packaging system for cleaning and filling of packages, the adapter assembly comprising:

an adapter body having a tubular body portion, a discoidal body portion at a first end of the tubular body portion, a dispensing passage and at least one venting or pressurizing passage extending through the adapter body from the first end to a second end of the tubular body portion, and a dip tube fitted to the first end of the tubular body portion and communicating with the dispensing passage;

a gasket surrounding the dip-tube and having at least one venting or pressurizing hole communicating with the venting or pressurizing passage of the adapter body; and a screw cap having an annular cap portion with a through-hole for the tubular body portion of the adapter body and having a skirt portion with an internal thread for engagement with the externally threaded neck of the packaging container, the screw cap being rotatable with respect to the adapter body, wherein the discoidal body portion has a recess surrounding the dip tube, the at least one venting or pressurizing passage of the tubular body portion opens into the recess, and the at least one venting or pressurizing hole of the gasket faces the recess.

19. The adapter assembly of claim 18, wherein the second end of the tubular body portion comprises an externally threaded portion for connecting the tubular body portion of the adapter body to the packaging system.

* * * * *